United States Patent [19]

Loepfe et al.

[11] 4,267,554

[45] May 12, 1981

[54] ELECTRONIC DEVICE FOR MONITORING A PLURALITY OF RUNNING THREADS ON A TEXTILE MACHINE

[75] Inventors: Erich Loepfe, Pfaffhausen; Erich Weidmann, Wetzikon; Walter Graf, Greifensee, all of Switzerland

[73] Assignee: Gebrueder Loepfe AG, Wetzikon, Switzerland

[21] Appl. No.: 46,852

[22] Filed: Jun. 8, 1979

[30] Foreign Application Priority Data

Jun. 19, 1978 [CH] Switzerland ..... 6632/78

[51] Int. Cl.[3] ..... G08B 21/00

[52] U.S. Cl. ..... 340/677; 57/81; 66/163; 226/100; 242/37 R

[58] Field of Search ..... 340/677; 57/81; 242/37 R; 66/163; 139/351, 370.1, 336; 226/11, 100

[56] References Cited

U.S. PATENT DOCUMENTS

| | | | |
|---|---|---|---|
| 3,863,241 | 1/1975 | Kamiyamaguchi et al. | 340/677 |
| 3,966,132 | 6/1976 | Gelin et al. | 242/37 R |
| 4,072,935 | 2/1978 | Rydborn | 139/370.1 |
| 4,140,919 | 2/1979 | Rydborn | 340/677 |

FOREIGN PATENT DOCUMENTS

| | | |
|---|---|---|
| 1535159 | 10/1970 | Fed. Rep. of Germany . |
| 2544528 | 12/1977 | Fed. Rep. of Germany . |
| 440073 | 12/1967 | Switzerland . |

*Primary Examiner*—Glen R. Swann, III

*Attorney, Agent, or Firm*—Werner W. Kleeman

[57] ABSTRACT

At each work position of a textile machine having a plurality of work positions driven by a common drive unit (warper's creels, winder or spooling and spinning machines, or circular knitting machines, for example), an electronic monitor device is provided which is responsive to thread travel. An indicator device is associated with each travel monitor and comprises a storage element and an indicator connected thereto, for the permanent indication of a thread breakage. To prevent false indications of thread breakage when the machine is stopped, a control signal is generated when the machine's drive unit is operating. Each indicator device further includes an electronic switch responsive to the control signal to insure the storage unit can be set to indicate a thread breakage only during operation of the drive unit.

4 Claims, 4 Drawing Figures

ELECTRONIC DEVICE FOR MONITORING A PLURALITY OF RUNNING THREADS ON A TEXTILE MACHINE

BACKGROUND OF THE INVENTION

The present invention relates to a new and improved electronic device for monitoring a plurality of running threads on a textile machine.

For monitoring a plurality of running threads on textile machines such as warper's creels (bobbin creels), knitting, winding or spooling and spinning machines, mechano-electric or electronic thread monitors are employed.

In German Patent Publication No. 1,535,159 and German Pat. No. 2,544,528, mechano-electric thread monitors are described in which each individual thread cooperates with a mechanical sensor or feeler element. This sensor element changes its position due to breakage of the thread and thus supplies an easily recognizable, individual indication of the location of the defect. At the same time an alarm or switch-off signal for the machine can be triggered by closing an electric circuit. All thread monitors in which the thread is sensed by a mechanical element, such as a lever or a drop pin, will respond to the tension of the thread. Thus, they cannot differentiate between a running thread and a stationary thread under tension. With thread breakages between the sensor or feeler element and the draw-off or wind-up position, it happens not infrequently that the end of the thread connected with the sensor element remains under tension due to being jammed or stuck on parts of the machine, so that thread breakages of this type are not detected by the thread monitor.

Electronic thread monitors do not have this fault since they are able to differentiate, on the one hand, between a running thread, and, on the other hand, a missing or stopped thread. Such a thread monitor for a warping machine is described in Swiss Pat. No. 440,073. Here, the output signals from the individual work positions are fed to a common switching amplifier via a collecting line.

Since a thread breakage is not easily recognized with an electronic thread monitor on a machine having a great number of work positions, special indicators, such as light-emitting diodes, would have to be provided, for individual indication, at all work positions. However, these would react not only to a thread rupture or breakage, but also to a standstill of the machine. In other words, every time the machine is stopped for whatever reason, all indicators will always respond. It is desirable, however, that thread breakage is indicated clearly and only at the running position of the thread at which the breakage has occurred.

SUMMARY OF THE INVENTION

Therefore, with the foregoing in mind it is a primary object of the present invention to provide a new and improved construction of electronic device for monitoring a plurality of running threads on a textile machine which is not associated with the aforementioned drawbacks and limitations of the prior art constructions.

Another and more specific object of the present invention is to create an electronic thread monitor or thread travel monitor for textile machines of the type mentioned, which, upon thread breakage or rupture, produces an individual indication at the relevant work position, but does not indicate a stopped condition of the machine in itself, in other words, without there having occurred a preceding thread breakage.

Now in order to implement these and still further objects of the invention, which will become more readily apparent as the description proceeds, the invention, generally speaking, provides an electronic device for monitoring a plurality of threads on a textile machine having a drive unit or device common to all thread travel positions, wherein a thread travel monitor is allocated to each thread for generating signals indicating a thread breakage and the outputs of the travel monitors are connected via a common line to a cut-off or shutdown device. According to important aspects of the invention, a circuit is provided for generating a control signal within the time interval for which the drive unit is switched-on. An indicator device is associated with each travel monitor and comprises a storage element and an indicator connected thereto, for the permanent indication of a thread breakage. Additionally, a switching element is associated with each travel monitor and insures that a signal, indicating a thread breakage, of the travel monitor, can set the storage element only over the duration of the control signal.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
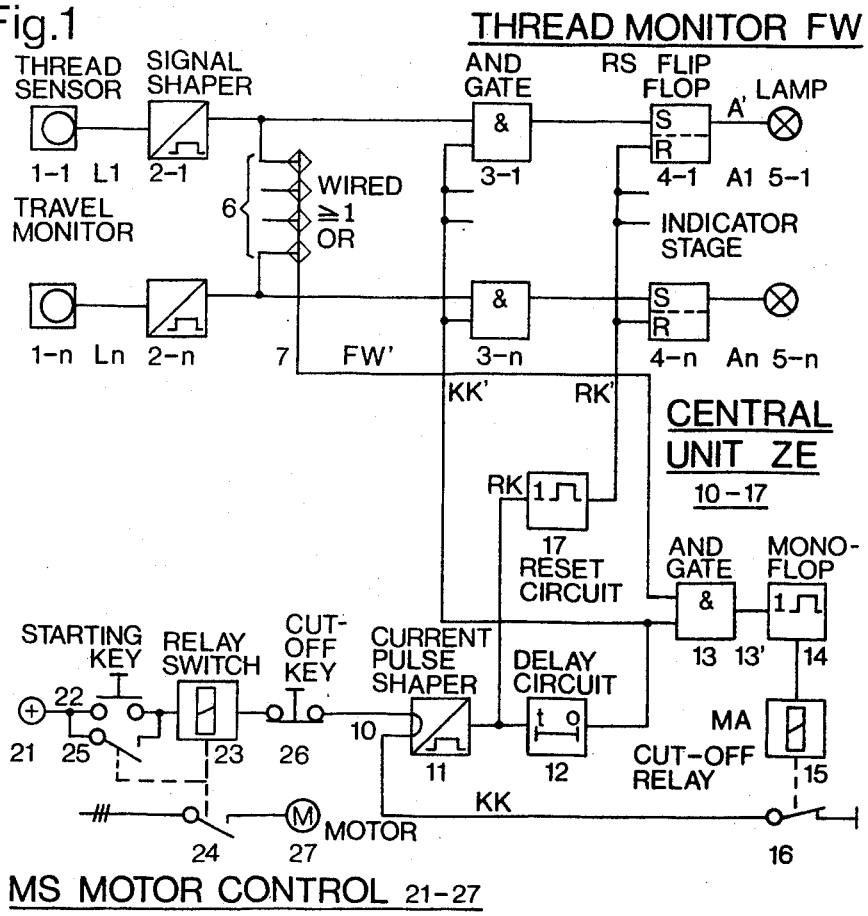
FIG. 1 is a block circuit diagram illustrating an electronic monitoring device constructed according to the present invention.

Describing now the drawings, FIG. 1 shows the components essential to the understanding of the invention of an electronic monitoring device used for simultaneous monitoring of the travel of a plurality of threads or like filamentary material at several work positions of the same type of a textile machine equipped with a common drive motor for driving all work positions. The textile machine, not shown as a matter of convenience, can be, for example, a warping machine, a twisting or doubling machine, a winder or spooling machine with a plurality of winding or spooling positions, or a circular knitting machine with a number of knitting systems.

As will be explained more fully hereinafter, the electronic monitoring device is designed in such a way that a thread rupture or breakage at any work position is indicated individually at this work position and that, furthermore, in this case the drive motor is switched off. Measures are also provided which make it possible to differentiate between such motor stoppages caused by thread breakages, and stoppages due to other causes.

Considered in greater detail, the electronic monitoring device comprises a thread monitor FW and a central unit or station ZE; in addition, a motor control circuit MS is shown which is part of the textile machine. The functional units of the central unit ZE comprise a control circuit KK with components 10–12, a motor cut-off stage MA with components 13–16, and a reset circuit RK with component 17.

The thread monitor FW comprises a number n of monitor units, each consisting of a thread travel monitor L1 to Ln, a switching element 3-1 to 3-n and an indicator stage A1 to An, as well as a wired OR-element or gate 6 with n inputs and bus 7 as output line. Each of the monitor units is allocated to one of the work positions of the textile machine. For reasons of clarity only the first and the last monitor unit are shown. Like each of the other travel monitors, the first travel monitor L1 consists of a thread sensor 1-1 and a signal evaluation circuit 2-1, hereafter called signal shaper for brevity. As thread sensors 1-1 . . . 1-n, there can be beneficially used piezo-electric, tribo-electric, capacitive, opto-electric and other sensors responding to thread travel as are well known in this art. The switching element 3-1 here is an AND-gate, and indicator A1 comprises a storage element 4-1 such as, for example, an RS-flip-flop and a preferably optical indicator 5-1.

The output of the first travel monitor L1 is firstly connected to one of the n inputs of the wired OR-gate 6 and, correspondingly, this applies to the other travel monitors. The output signal of the wired OR-gate 6 is the thread monitor signal FW'. Secondly, there is a series connection from the output of the travel monitor L1 via the first input of AND-gate 3-1 and the S input of the storage element 4-1 to the indicator 5-1.

The output of the wired OR-gate 6 is connected via bus 7 to the first input of the motor cut-off stage MA arranged in the central unit ZE. The motor cut-off stage MA consists of a logic element and particularly an AND-gate 13, a pulse generator 14 actuated upon thread breakage, for example a one-shot or monoflop, and connected to this pulse generator 14 a cut-off relay 15 with a normally closed contact 16 (rest contact) arranged in the motor control stage MS.

The motor control stage MS contains a circuit breaker or relay switch 23 with a closing contact or motor switch 24 arranged in the supply line of the drive motor 27 of the textile machine. The control loop containing the coil of the relay switch 23 goes from a control source 21 via a starting key 22, the coil mentioned, a normally closed cut-off key 26, a current loop 10 and a contact 16 of the cut-off relay 15 to earth or ground. In addition, connected in parallel with the starting key 22 is a normally open holding contact 25 of the relay switch 23.

The control circuit KK determines the time interval, after switch-on of the drive motor 27, during which the individual threads are monitored by the thread monitor FW. It comprises a current converter 11, such as a current pulse shaper, connected to the current loop 10, which can be provided, for example, with an opto-coupler. Connected with the current converter 11 is a delay element 12 producing an initial time delay t of about 1 second in the output signal supplied by the current converter 11.

The output signal of the control circuit KK is a control signal KK' in the form of a DC voltage. The control signal KK' is fed firstly to the second input of the AND-gate 13 of the motor cut-off stage MA, and secondly, to the second inputs of AND-gates 3-l to 3-n of thread monitor FW.

In the reset circuit RK comprises a one-shot or monoflop 17 connected to the output of the current converter or shaper 11, and its output is connected to the reset inputs R of the storage elements 4-1 to 4-n of thread monitor FW. The output signal of the reset circuit RK is a reset signal or reset pulse RK'.

Figure 2:
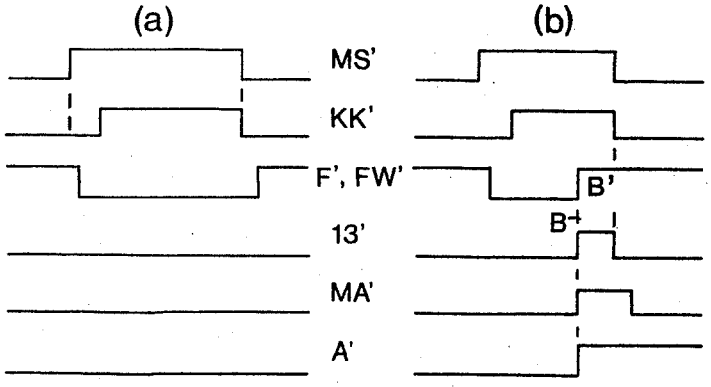
FIG. 2 diagramatically shows the signals occurring in the electronic monitoring device of FIG. 1, and specifically, at the diagram portion labeled (a) the signals occurring during normal operation and at the diagram portion (b) the signals occurring in the case of thread breakage.

In the description which follows, the function of the device shown in FIG. 1 is explained with the aid of the signal diagrams shown in FIG. 2. The signals or pulses shown under (a) here indicate the processes or operations which occur after starting and stopping the drive motor 27 manually by means of keys 22 and 26 respectively, while those under (b) illustrate the case of a switch-off due to a thread rupture or breakage at one of the travel monitors L1 to Ln.

The thread monitor FW is designed in such a way that the signal shapers 2-1 to 2-n, when the related thread is traveling, in each case supply a travel signal F' of value L (logical ZERO) and with standstill of the thread a signal of value H (logical ONE), while RS-flip-flops 4-1 to 4-n in their initial state supply at their outputs in each case an L signal and are set by a positive pulse at their S inputs which makes the output signal go from value L to H and thus produces a permanent indication by the relevant indicator from amongst indicators 5-1 to 5-n.

According to FIG. 2(*a*), a switching-on and subsequent switching-off of the drive motor 27 by momentarily operating keys 22 and 26 produces a current signal MS' in the loop 10. This is transformed in the control circuit KK into a control signal KK', the leading edge of which is delayed by a time interval t of about 1 second with respect to that of the current signal MS', whereas the trailing edges of the signals MS' and KK' occur practically simultaneously.

The duration of the control signal KK' determines the time interval of monitoring of the running or traveling threads by the thread monitor FW. The time interval t of the initial delay is chosen to be of such magnitude that at the start of the control signal KK' all threads are already running and producing a defined travel signal F' of value L.

After motor 27 is turned-off the thread travel signal F' and the thread monitor signal FW', corresponding thereto, jump from value L to H after a short run-down delay—the motor and the machine do not come to a stop immediately.

The signals FW' and KK' are compared in the AND-gate 13 of the motor cut-off stage MA. Since the two signals never assume the value H at the same time the output signal 13' of the AND-gate 13, and thus, also the output signal MA' of the one-shot or mono-flop 14, always remain at L. Thus, the rest contact 16 in the motor control circuit MS is also not actuated. In addition, the AND-gates 3-1 to 3-n in this case remain disabled for the travel signal F', so that the RS-flip-flops 4-1 to 4-n are not set and their output signals A' remain at L. Consequently, none of the indicators 5-1 to 5-n are actuated if the travel signal F' assumes value H after the motor is switched-off and the thread comes to a standstill.

According to FIG. 2(*b*), switching-on the motor 27 will trigger the current signal MS' and the control signal KK' just as in the case of FIG. 2(*a*). However, assume there is a thread rupture or breakage at the travel monitor L1 with the motor 27 still running, causing the travel signal F' and the thread monitor FW', at the position designated (B), to jump from L to H, i.e. to become the break or rupture signal B'. Since, immediately after the thread breakage, the control signal KK' is still at H, the AND-gate 3-1 is open for the positive break signal B', so that the RS-flip-flop 4-1 is set and the indicator 5-1 is actuated by the positive output signal A' of the RS-flip-flop 4-1. The indication persists even after the positive control signal KK' disappears since the RS-flip-flop 4-1 remains set.

In the logic element 13 the positive break signal, B' or FW' respectively, is combined with the positive control signal KK' to form a positive output signal 13'. This output signal 13' further actuates the one-shot or monoflop 14 of the motor cut-off stage MA which supplies a cut-off pulse MA', actuating the cut-off relay 15. This momentarily breaks the contact 16 and the holding or locking contact 25 of the relay switch 23 and the motor switch 24 are again opened. Consequently, the current signal MS' also disappears, and with it the control signal KK'.

The other n-1 AND-gates 3-2 to 3-n are also controlled by the control signal KK'; as long as they do not receive a thread breakage signal, the travel signal F' will remain at L there, so that the RS-flip-flops 4-2 to 4-n are not set and there is no indication.

If the starting key 22 is operated again the machine will start-up again. If the thread breakage or rupture has been previously eliminated, the machine will continue to run, otherwise it will be switched-off again immediately automatically.

The indication of the indicator 5-1 remains until the RS-flip-flop 4-1 is reset again. This happens the next time the machine is switched-on, by means of the reset circuit RK. When the leading edge of the current signal MS' occurs, the one-shot or monoflop 17 supplies a short reset pulse RK' of several ms duration, which is fed to all the RS-flip-flops 4-1 to 4-n and resets the set RS-flip-flop 4-1, while not affecting the other RS-flip-flops which are not set.

Figure 3:
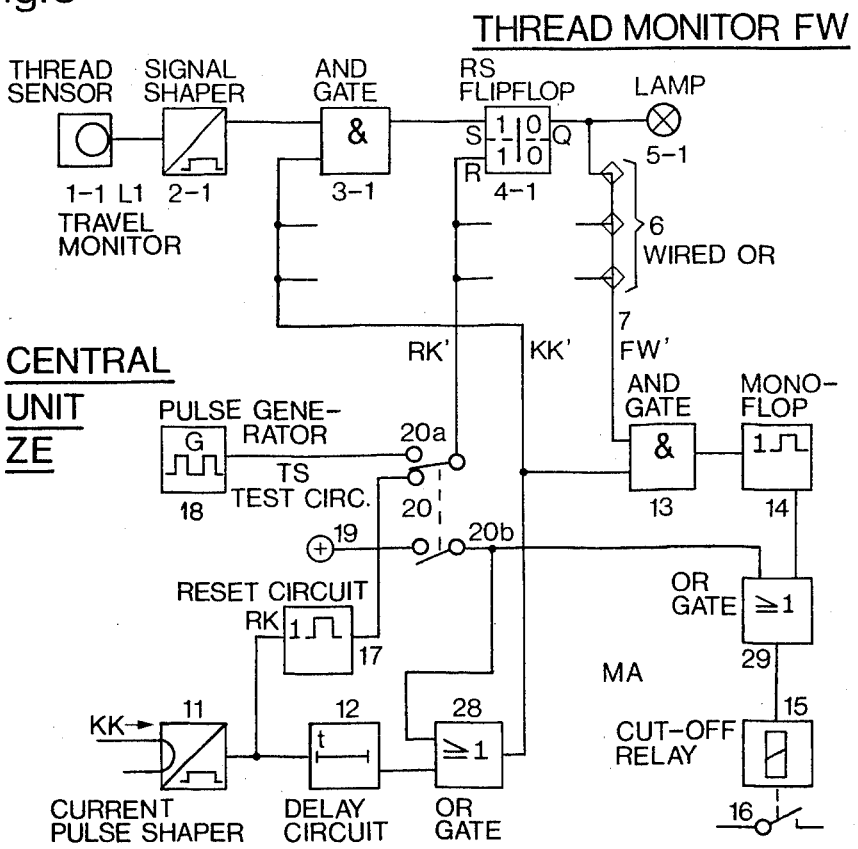
FIG. 3 is a block circuit diagram illustrating another embodiment of electronic monitoring device constructed according to the invention.

FIG. 3 shows an embodiment of electronic monitoring device which is modified and elaborated with respect to FIG. 1. For reasons of simplicity, only the first monitor unit with components 1-1 to 5-1 is here shown. Identical or corresponding components are conveniently provided with identical reference characters in both figures. The motor control circuit MS, which can have the same design as in FIG. 1, is not shown in FIG. 3 for simplicity sake.

As essential difference with respect to FIG. 1 consists in that the wired OR-gate or circuit 6, and thus the bus 7, are connected to the Q outputs of the RS-flip-flops 4-1 . . . 4-n, and not to the outputs of the travel monitors L1 . . . Ln. In the circuit according to FIG. 3, there can additionally be provided an indicator, for example, a light-emitting diode, in the central unit ZE, which indicator can be connected directly to the collecting line 7.

Further, in FIG. 3 there is provided a test circuit TS containing the essential components 18, 19 and 20, as will be explained shortly. This makes it possible to check the operation of the individual monitor units 1-1 to 5-1 and 1-n to 5-n, with the machine stopped. The test circuit TS can be made operative instead of the control circuit KK and the reset circuit RK, by switching over the contacts 20*a* and 20*b* of the test switch 20. The test circuit TS comprises a pulse generator 18 and a DC source 19, as shown, in addition to the test switch 20.

In the position of the test switch 20, shown in FIG. 3, the output of the control circuit KK is connected via a first OR-gate 28 to the second inputs of AND-gates 3-1 to 3-n of the thread monitor FW and with the second input of the AND-gate 13 of the motor cut-off circuit MA. The output of the reset circuit RK is connected to the R inputs of the RS-flip-flop 4-1 to 4-n. Despite the different derivation of the thread monitor signal FW', the operation of the monitoring device is similar to that of the circuit shown in FIG. 1. With the motor control circuit MS and the drive motor 27 switched-on, and with normal thread travel, the signal at the S input of the RS-flip-flop 4-1 is at L and the signal at the Q output is also at L. With a thread breakage or rupture within the period of the control signal KK', the input signal at the S input, and thus, also the signal at the Q output goes to H and remains at this value even after the machine has stopped and the control signal KK' has disappeared. Thus, the indication of the indicator 5-1, enabled by the H signal at the Q output will also persist. It makes no difference that there is now an FW' signal of value H also at the first input of the AND-gate 13 of the motor cut-off circuit MA, since the one-shot or monoflop 14 is triggered only once by the leading edge of the output signal 13'.

Figure 4:
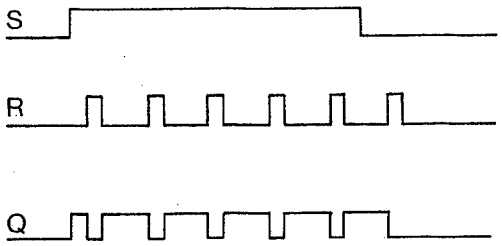
FIG. 4 is a pulse diagram useful for explaining the action of a storage element shown in the circuit arrangement of FIG. 3.

In the text which follows, the performance of a test is described with the aid of FIG. 3 and FIG. 4. First, the test circuit TS is made ready or placed in its preparatory state by switching-on the test switch 20. On the one hand, this connects the DC source 19 via the contact 20*b* and via a second OR-gate 29 to the cut-off relay 15, so that its contact 16 is permanently broken. Further, the DC source 19 is applied via the first OR-gate 28 to the second inputs of AND-gates 3-1 to 3-n, i.e. a control signal KK' of value H is simulated. Since with a stopped machine the output signal F' of the travel monitors L1 to Ln is at H, there will be an H signal at the first input of AND-gates 3-1 to 3n and also at the S input of the RS-flip-flop 4-1 to 4-n. At the R input of the latter there appears the output pulse of the pulse generator 18, see FIG. 4 diagram R, in the form of a series of short positive pulses of long pulse interval. As long as the signal at the S input, see diagram S in FIG. 4, is at H, a series of pulses will appear at the Q output, which series has short gaps over the duration of the positive pulses of the R signal. If the repetition rate of the pulses supplied by the pulse generator 18 is high enough, for example 50 Hz or more, the human eye will see the indication supplied by the optical indicator 5-1 to 5n, as a constant display.

In order to check the monitor unit, assume the thread be pulled by hand briefly through the thread sensor 1-1. This produces a travel signal F' of value L which also appears at the S input of the RS-flip-flop 4-1. With the appearance of the next pulse at the R input, the Q signal at the output Q of the RS-flip-flop 4-1 will disappear, and thus also the indication of the indicator 5-1. The latter will light up again only if the thread is stopped and produced an H signal. Thus the display of the light-emitting diode can be interrupted briefly several times by successively briefly plucking the thread, indicating the correct operation of the monitor unit.

In this way all the monitor units can be checked one after the other easily and quickly, which is not possible with the known electronic monitoring units of similar type.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. In an electronic device for monitoring a plurality of threads on a textile machine having a drive unit common to all thread travel positions, drive unit control means and a plurality of travel monitors, one being allocated to each thread for generating signals indicating a thread breakage, the outputs of the travel monitors being connected via a common line to a cut-off device, the improvement which comprises:

a circuit activated by said drive unit control means for generating a D.C. control signal within the time interval for which the drive unit is switched on;

a plurality of indicator-devices, one operatively associated with each travel monitor, each said indicator device comprising a storage element and an indicator connected thereto, for permanent indication of a thread breakage; and a plurality of switching elements, one operatively associated with each travel monitor, each said switching element ensuring that a signal, indicating a thread breakage, of the related travel monitor, can set the related storage element only over the duration of the D.C. control signal.

2. In an electronic device for monitoring a plurality of threads on a textile machine having a drive unit common to all thread travel positions, and a plurality of travel monitors, one being allocated to each thread for generating signals indicating a thread breakage, the outputs of the travel monitors being connected via a common line to a cut-off device, the improvement which comprises:

a circuit for generating a D.C. control signal within the time interval for which the drive unit is switched on, comprising:

a current pulse shaper controlled by a current signal determining the time of running of the drive unit;

a delay element connected to said current pulse shaper, said delay element having a time delay which is such that at the beginning of the control signal all travel monitors each produce a travel signal indicating the running of the thread;

a plurality of indicator devices, one operatively associated with each travel monitor, each said indicator device comprising a storage element and an indicator connected thereto, for permanent indication of a thread breakage; and a plurality of switching elements, one operatively associated with each travel monitor, each said switching element ensuring that a signal, indicating a thread breakage, of the related travel monitor, can set the related storage element only over the duration of the control signal.

3. In an electronic device for monitoring a plurality of threads on a textile machine having a drive unit common to all thread travel positions, and a plurality of travel monitors, one being allocated to each thread for generating signals indicating a thread breakage, the outputs of the travel monitors being connected via a common line to a cut-off device, the improvement which comprises:

a circuit for generating a control signal within the time interval for which the drive unit is switched on;

a plurality of indicator devices, one operatively associated with each travel monitor, each said indicator device comprising a storage element and an indicator connected thereto, for permanent indication of a thread breakage;

a plurality of switching elements, one operatively associated with each travel monitor, each said switching element ensuring that a signal, indicating a thread breakage, of the related travel monitor, can set the related storage element only over the control signal; and switching means provided for said travel monitors by means of which said storage elements can be disabled for purposes of testing the travel monitors, so that the output signal of each travel monitor can reach the related indicator device without being stored.

4. In an electronic device for monitoring a plurality of threads on a textile machine having a drive unit common to all thread travel positions, and a plurality of travel monitors, one being allocated to each thread for generating signals indicating a thread breakage, the outputs of the travel monitors being connected via a common line to a cut-off device, the improvement which comprises:

a circuit for generating a control signal within the time interval for which the drive unit is switched on;

a plurality of indicator devices, one operatively associated with each travel monitor, each said indicator device comprising a storage element and an indicator connected thereto, for permanent indication of a thread breakage;

a plurality of switching elements, one operatively associated with each travel monitor, each said switching element ensuring that a signal, indicating a thread breakage, of the related travel monitor, can set the related storage element only over the duration of the control signal, and switching means for resetting the storage elements automatically after the drive unit has been switched on.

* * * * *